United States Patent [19]

Takeuchi

[11] Patent Number: 4,996,935

[45] Date of Patent: Mar. 5, 1991

[54] STABLE RACING CATARMARAN WITH HYDROFOIL QUALITIES

[76] Inventor: Richard T. Takeuchi, 3518 Harding Ave., Honolulu, Hi. 96816

[21] Appl. No.: 523,078

[22] Filed: May 14, 1990

[51] Int. Cl.[5] ..... B63B 1/00

[52] U.S. Cl. ..... 114/61; 114/163; 114/265

[58] Field of Search ..... 114/61, 56, 57, 123, 114/270, 274, 283, 264, 266, 162, 163

[56] References Cited

U.S. PATENT DOCUMENTS

| | | | |
|---|---|---|---|
| 2,996,030 | 8/1961 | Lornson | 114/61 |
| 4,174,671 | 11/1979 | Seidl | 114/61 |
| 4,440,103 | 4/1984 | Lang | 114/61 |
| 4,552,083 | 11/1985 | Schmidt | 114/61 |
| 4,763,596 | 8/1988 | Yoshida | 114/61 |
| 4,919,063 | 4/1990 | Hall et al. | 114/61 |

*Primary Examiner*—Sherman Basinger
*Assistant Examiner*—Stephen P. Avila
*Attorney, Agent, or Firm*—Michael I. Kroll

[57] ABSTRACT

A stable racing catamaran with hydrofoil qualities is disclosed. The stable racing catamaran with hydrofoil qualities includes a deck, a pair of forward pylons affixed to the deck, a pair of aft pylons affixed to the deck, a pair of forward hulls affixed to the pair of forward pylons, respectively, a pair of aft hulls affixed to the pair of aft pylons, respectively, a pair of forward skags affixed to the pair of forward hulls, respectively, a pair of aft skags affixed to the pair of aft hulls, respectively, a pair of forward rudders disposed in close proximity to the pair of forward hulls, respectively, a pair of aft rudders disposed in close proximity to the pair of aft hulls, respectively, a pair of forward rudder shafts for rotatably mounting the pair of forward rudders, respectively, and a pair of aft rudder shafts for rotatably mounting the pair of aft rudders, respectively. Furthermore, the present invention reduces resistance and minimizes drag by streamlining, the hulls of the present invention are removably mounted so that hulls with different designs and/or displacements can be quickly and easily interchanged, unwanted lateral motion and drift that affects stability are minimized by the present invention, and unwanted yaw motion that affects stability is also minimized by the present invention.

21 Claims, 3 Drawing Sheets

STABLE RACING CATARMARAN WITH HYDROFOIL QUALITIES

BACKGROUND OF THE INVENTION

1. Field of the Invention

The present invention relates to a racing catamaran.

More particularly, the present invention relates to a stable racing catamaran with hydrofoil qualities.

2. Description of the Prior Art

In the case of a body moving through a fluid for which the measured pressure distribution nearly agrees with the perfect-fluid theory, the influence of viscosity at high Reynolds numbers is confined to a very thin layer in the immediate neighborhood of the body.

If the condition of no slip were no to be satisfied in the case of a real fluid there would be not appreciable difference between the field of flow of the real fluid, as compared with that of a perfect fluid.

The fact that at the body the fluid adheres to it means, however, that frictional forces are retarding the motion of the body in a thin layer near the body. In that thin layer, the velocity of the fluid increases from zero at the body (no slip) to its full value which corresponds to the external frictionless flow. This layer is called the boundary layer.

The decelerated fluid particles in the boundary layer do not, in all cases, remain in the thin layer which adheres to the body along the whole wetted length of the body. In some cases, the boundary layer increases its thickness considerably in the downstream direction and causes the flow in the boundary layer become reversed. This causes the decelerated fluid particles to be forced outward, which means that the boundary layer becomes separated from the body. We then speak of boundary-layer separation.

This phenomenon is always associated with the formation of vortices and with large energy losses in the wake of the body. Behind the body there exists a region of strongly decelerated flow (wake), in which the pressure distribution deviates considerably from that in a frictionless fluid. The large drag on such a body can be explained by the existence of this large deviation in pressure distribution, which is in turn, a consequence of boundary-layer separation.

Boundary layer separation reduces the lifting properties of a body moving through a fluid. At small angles of incidence (up to about $10^0$), the flow does not separate on either side of the body and closely approximates frictionless conditions. With increasing incidence there is danger of separation on the suction side of the body, because the pressure increase becomes steeper. For a given angle of incidence, of about $15^0$, separation will occur.

The separation point is located fairly closely behind the leading edge of the body moving through the fluid and its wake contains a large "dead-water" area. The frictionless, lift-creating flow pattern has now become disturbed, and the drag on the body has become very large. The beginning of separation nearly coincides with the occurrence of maximum lift of the body.

Separation is mostly an undesirable phenomenon because it entails large energy losses. For this reason methods have been devised for the artificial prevention of separation. The simplest method, from the physical point of view, is to move the body through the fluid with the stream in order to reduce the velocity difference between them, and hence to remove the cause of boundary layer formation to begin with.

In later years, suction was successfully used to increase the lift on bodies. Owing to suction on the upper surface near the trailing edge of the moving body the flow adheres to the body at considerably larger angles of incidence than would otherwise be the case. Stalling is delayed, and much larger maximum-lift values can be achieved.

Numerous innovations for racing catamarans have been provided in the prior art that are adapted to be used. Even though these innovations may be suitable for the specific individual purposes to which they address, they would not be suitable for the purposes of the present invention as heretofore described.

SUMMARY OF THE INVENTION

Accordingly, it is an object of the present invention to provide a racing catamaran that avoids the disadvantages of the prior art.

More particularly, it is an object of the present invention to provide a racing catamaran whose performance is improved by converting it vessel from a semi-planing vessel to that of a full planing vessel, and whose longitudinal pitching stability and whose lateral stability is greatly improved.

The waves' kinetic energy coming from the bottom planing area of the forward hulls help lift the aft hulls. Additionally, the forward hulls part the water ahead of the aft hulls and lessen the aft hull resistance in the forward direction.

Furthermore, the stable racing catamaran with hydrofoil qualities of the present invention includes improved rideability, improved fuel consumption due to the kinetic energy from the waves, reduced resistance, and increased lift.

The creation of a "back surge" between the four hulls of the present invention is similar to that found at the stern of a monohull. Also, a single "rooster tail" is formed behind the present invention, at highspeed. The present invention's ability to plane going windward or with the wind, greatly enhances its speed potential. The stabilizers and the planing surfaces greatly restrict the pitching and rolling motions of the present invention. The lack of pitching greatly improves the performance of the sails when wind power is used to propel the present invention.

In keeping with these objects, and with others which will become apparent hereinafter, one feature of the present invention resides, briefly stated, in a stable racing catamaran with hydrofoil qualities, and including, a deck, a pair of forward pylons affixed to the deck, a pair of aft pylons affixed to the deck, a pair of forward hulls affixed to the pair of forward pylons, respectively, a pair of aft hulls affixed to the pair of aft pylons, respectively, a pair of forward skags affixed to the pair of forward hulls, respectively, a pair of aft skags affixed to the pair of aft hulls, respectively, a pair of forward rudders disposed in close proximity to the pair of forward hulls, respectively, a pair of aft rudders disposed in close proximity to the pair of aft hulls, respectively, a pair of forward rudder shafts for rotatably mounting the pair of forward rudders, respectively, and a pair of aft rudder shafts for rotatably mounting the pair of aft rudders, respectively.

When the stable racing catamaran with hydrofoil qualities is designed in accordance with the present invention, air resistance is reduced and drag is minimized by streamlining, different design and/or displacement hulls can be quickly and easily changed, unwanted lateral motion and drift that affects stability are minimized, and unwanted yaw motion that affects stability is minimized.

In accordance with another feature of the present invention, the deck is substantially flat and includes a pair of sides having contours, an upper surface, a forward portion, and an aft portion.

Another feature of the present invention is that the pair of forward pylons include a pair of upper surfaces, respectively, a pair of lower surfaces, respectively, and a pair of bodies, respectively, the bodies are shaped and positioned so as to match the contours, respectively, of the pair of sides, respectively, of the deck so that air resistance is reduced and drag is minimized by streamlining.

Yet another feature of the present invention is that the pair of forward pylons are affixed to the forward portion of the deck where the pair of upper surfaces, respectively, of the pair of forward pylons, respectively, meet the lower surface of the deck.

Still another feature of the present invention is that the pair of aft pylons, respectively, include a pair of upper surfaces, respectively, a pair of lower surfaces, respectively, and a pair of bodies, respectively, the pair of bodies are shaped and positioned so as to match the contour, respectively, of the pair of sides, respectively, of the deck so that air resistance is further reduced and drag is further minimized by further streamlining.

Yet still another feature of the present invention is that the pair of aft pylons are affixed to the aft portion, respectively, of the deck where the pair of upper surfaces, respectively, of the pair of aft pylons, respectively, meet the lower surface of the deck.

Still yet another feature of the present invention is that the pair of forward hulls include a pair of upper surfaces, respectively, a pair of lower surfaces, respectively, a pair of bodies, respectively, and a pair of rear edges, respectively.

Another feature of the present invention is that the pair of forward hulls are affixed to the pair of forward pylons, respectively, where the pair of upper surfaces, respectively, of the pair of forward hulls, respectively, meet the pair of lower surfaces, respectively, of the pair of forward pylons, respectively.

Yet another feature of the present invention is that the pair of aft hulls include a pair of upper surfaces, respectively, a pair of lower surfaces, respectively, a pair of bodies, respectively, and a pair of rear edges, respectively.

Still another feature of the present invention is that the pair of aft hulls are affixed to the pair of aft pylons, respectively, where the pair of upper surfaces, respectively, of the pair of aft hulls, respectively, meet the pair of lower surfaces, respectively, of the pair of aft pylons, respectively.

Yet still another feature of the present invention is that the pair of forward skags include a pair of upper surfaces, respectively, a pair of lower fins, respectively, and a pair of rear portions, respectively.

Still yet another feature of the present invention is that the pair of forward skags are affixed to the pair of forward hulls, respectively, where the pair of upper surfaces, respectively, of the pair of forward skags, respectively, meet the pair of lower surfaces, respectively, of the pair of forward hulls, respectively.

Another feature of the present invention is that the pair of aft skags include a pair of upper surfaces, respectively, a pair of lower fins, respectively, and a pair of rear portions, respectively.

Yet another feature of the present invention is that the pair of aft skags are affixed to the pair of aft hulls, respectively, where the pair of upper surfaces, respectively, of the pair of aft skags, respectively, meet the pair of lower surfaces, respectively, of the pair of aft hulls, respectively.

Still another feature of the present invention is that the pair of forward rudders include a pair of bodies, respectively, each of which containing a longitudinal throughbore, the pair of forward rudders further include a pair of lower surfaces, respectively, and a pair of front portions, respectively.

Yet still another feature of the present invention is that the pair of aft rudders include a pair of bodies, respectively, each of which containing a longitudinal throughbore, the pair of aft rudders further include a pair of lower surfaces, respectively, and a pair of front portions, respectively.

Still yet another feature of the present invention is that the pair of forward rudder shafts include a pair of substantially cylindrical bodies, respectively, a pair of upper ends, respectively, and a pair of lower ends, respectively, Another feature of the present invention is that it further includes a pair of forward rudder shaft caps.

Yet another feature of the present invention is that the pair of forward rudders are rotatably mounted by use of the pair of forward rudder shafts, respectively, the pair of forward rudder shafts pass through the longitudinal throughbores, respectively, contained in the pair of forward rudders, respectively, the pair of front portions, respectively, of the pair of forward rudders, respectively, are positioned adjacent to the pair of rear edges, respectively, of the pair of forward hulls, respectively.

Still another feature of the present invention is that the pair of forward rudders ar held adjacent to the pair of rear edges, respectively, of the pair of forward hulls, respectively, by the pair of upper ends, respectively, of the pair of forward rudder shafts, respectively, being affixed to the pair of forward rudder shaft caps, respectively, and the pair of lower ends, respectively, of the pair of forward rudder shafts, respectively, are affixed to the pair of rear portions, respectively, of the pair of forward skags, respectively.

Yet still another feature of the present invention is that the pair of aft rudder shaft include a pair of substantially cylindrical bodies, respectively, a pair of upper ends, respectively, and a pair of lower ends, respectively.

Still yet another feature of the present invention is that it further comprises a pair of aft rudder shaft caps.

Another feature of the present invention is that the pair of aft rudders are rotatably mounted by use of the pair of aft rudder shafts, respectively, the pair of aft rudder shafts pass through the longitudinal throughbores, respectively, contained in the pair of aft rudders, respectively, the pair of front portions, respectively, of the pair of aft rudders, respectively, are positioned adjacent to the pair of rear edges, respectively, of the pair of aft rudders, respectively.

Yet another feature of the present invention is that the pair of aft rudders are held adjacent to the pair of rear edges, respectively, of the pair of aft hulls, respectively, by the pair of upper ends, respectively, of the pair of aft rudder shafts, respectively, being affixed to the pair of aft rudder shaft caps, respectively, and the pair of lower ends, respectively, of the pair of aft rudder shafts, respectively, are affixed to the pair of rear portions, respectively, of the pair of aft skags, respectively.

Still another feature of the present invention is that the pair of forward hulls are removably mounted to the pair of forward pylons, respectively, so that the pair of forward hulls are interchangeable and can have different designs and displacements which can be quickly and readily attached to or removed from the pair of forward pylons, respectively, as required by the user.

Yet still another feature of the present invention is that it further comprises a plurality of nuts and bolts for removably affixing the pair of forward hulls, respectively, to the pair of forward pylons, respectively.

Still yet another feature of the present invention is that the pair of aft hulls are removably mounted to the pair of aft pylons, respectively, so that the pair of aft hulls are interchangeable and can have different designs and displacements, which can be quickly and readily attached to or removed from the pair of aft pylons, respectively, as required by the user.

Another feature of the present invention is that it further comprises a plurality of nuts and bolts for removably affixing the pair of aft hulls, respectively, to the pair of aft pylons, respectively.

Yet another feature of the present invention is that the pair of bodies of the pair of forward hulls, respectively, and the pair of bodies of the pair of aft hulls, respectively, have centers of lateral resistance, respectively, disposed thereon, the centers of lateral resistance absorb lateral forces impinged thereon and minimize unwanted side-to-side lateral motion and drift that affects stability.

Still another feature of the present invention is that the pair of forward hulls and the pair of aft hulls have pivotal points disposed therethrough, the pivotal points, respectively, of the forward hulls, respectively, and the pivotal points, respectively, of the aft hulls, respectively, work in conjunction with each other to minimize unwanted yaw motion that affects stability.

Yet still another feature of the present invention is that the pair of forward hulls create waves that contain kinetic energy, the kinetic energy produces lifting forces on the pair of aft skags, respectively, of the pair of aft hulls, respectively, which reduces resistance encountered by the pair of aft hulls, respectively.

The novel features which are considered characteristic for the invention are set forth in particular in the appended claims. The invention itself, however, both as to its construction and its method of operation together with additional objects and advantages thereof, will be best understood from the following description of the specific embodiments when read in connection with the accompanying drawing.

LIST OF REFERENCE NUMERALS UTILIZED IN THE DRAWING

Figures 1, 2, 3:
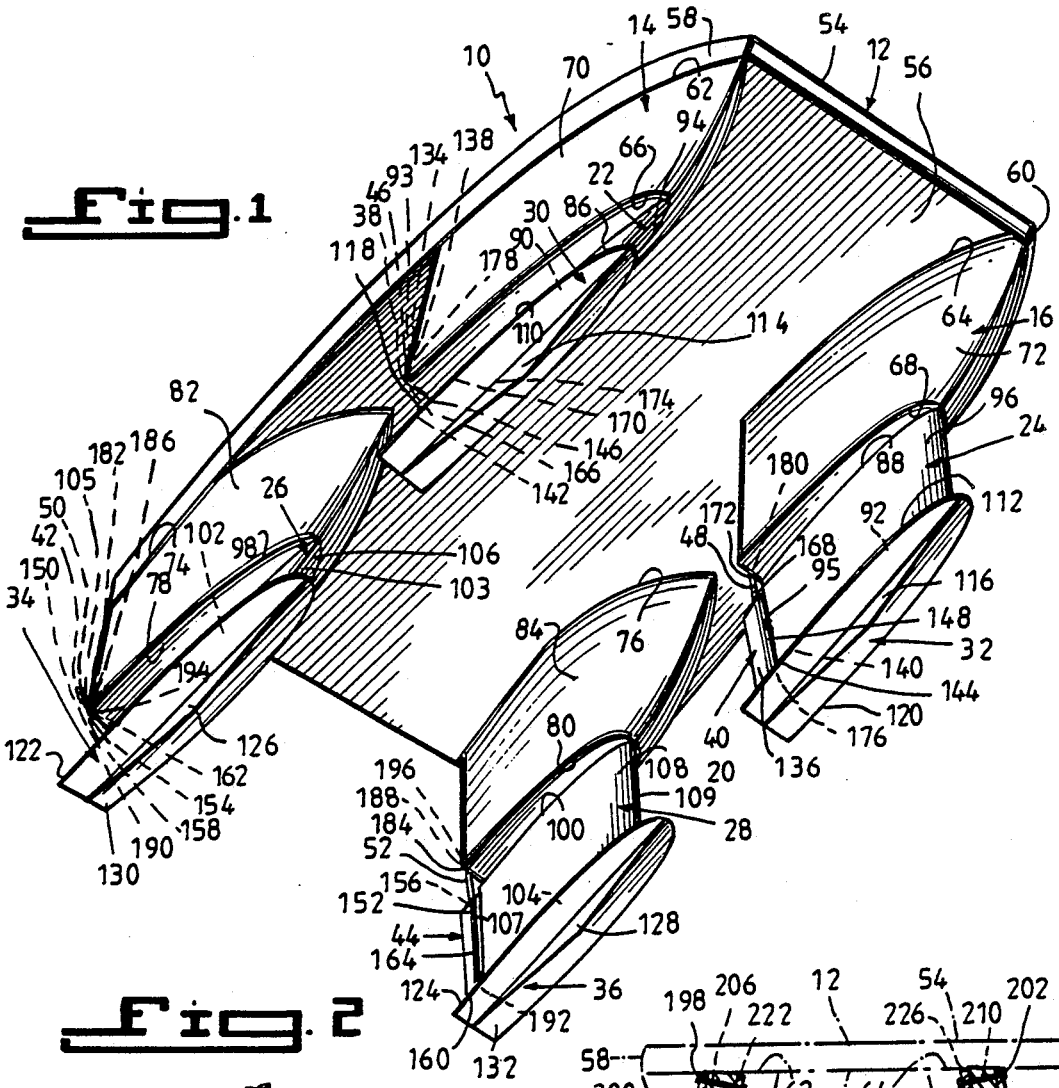
FIG. 1 is a bottom perspective view of the stable racing catamaran with hydrofoil qualities of the present invention.
FIG. 2 is a front view of the stable racing catamaran with hydrofoil qualities of the present invention, shown in FIG. 1.
FIG. 3 is a front cross sectional view of the stable racing catamaran with hydrofoil qualities of the present invention, shown in FIG. 2 and with the deck, shown in phantom.

10—stable racing catamaran with hydrofoil qualities of the present invention
11—at least one mast placeable on the stable racing catamaran with hydrofoil qualities 10
12—substantially flat deck of the stable racing catamaran with hydrofoil qualities 10
14—a forward pylon
16—other forward pylon
18—an aft pylon
20—other aft pylon
22—a forward hull
24—other forward hull
26—an aft hull
28—other aft hull
30—a forward skag
32—other forward skag
34—an aft skag
36—other aft skag
38—a forward rudder
40—other forward rudder
42—an aft rudder
44—other aft rudder
46—a forward rudder shaft
48—other forward rudder shaft
50—an aft rudder shaft
52—other aft rudder shaft
54—upper surface of the substantially flat deck 12
56—lower surface of the substantially flat deck 12
58—a contoured side of the substantially flat deck 12
60—other contoured side of the substantially flat deck 12
62—upper surface of the forward pylon 14
64—upper surface of the other forward pylon 16
66—lower surface of the forward pylon 14
68—lower surface of the other forward pylon 16
70—body of the forward pylon 14
72—body of the other forward pylon 16
74—upper surface of the aft pylon 18
76—upper surface of the other aft pylon 20
78—lower surface of the aft pylon 18
80—lower surface of the other aft pylon 20
82—body of the aft pylon 18
84—body of the other aft pylon 20
86—upper surface of the forward hull 22
88—upper surface of the other forward hull 24
90—lower surface of the forward hull 22

92—lower surface of the other forward hull 24
93—rear edge of the forward hull 22
94—body of the forward hull 22
95—rear edge of the other forward hull 24
96—body of the other forward hull 24
98—upper surface of the aft hull 26
100—upper surface of the other aft hull 28
102—lower surface of the aft hull 26
102—front portion of the aft hull 26
104—lower surface of the other aft hull 28
105—rear edge of the aft hull 26
106—body of the aft hull 26
107—rear edge of the other aft hull 28
108—body of the other aft hull 28
109—front portion of the other aft hull 28
110—upper surface of the forward skag 30
112—upper surface of the other forward skag 32
114—lower fin of the forward skag 30
116—lower fin of the other forward skag 32
118—rear portion of the forward skag 30
120—rear portion of the other forward skag 32
122—upper surface of the aft skag 34
124—upper surface of the other skag 36
126—lower fin of the aft skag 34
128—lower fin of the other aft skag 36
130—rear portion of the aft skag 34
132—rear portion of the other aft skag 36
134—body of the forward rudder 38
136—body of the other forward rudder 40
138—longitudinal throughbore contained in the body 134
140—longitudinal throughbore contained in the body 136
142—lower surface of the forward rudder 38
144—lower surface of the other forward rudder 40
146—front portion of the forward rudder 38
148—front portion of the other forward rudder 40
150—body of the aft rudder 42
152—body of the other aft rudder 44
154—longitudinal throughbore contained in the body 150
156—longitudinal throughbore contained in the body 152
158—lower surface of the aft rudder 42
160—lower surface of the other aft rudder 44
162—front portion of the aft rudder 42
164—front portion of the other aft rudder 44
166—substantially cylindrical body of the forward rudder shaft 46
168—substantially cylindrical body of the other forward rudder shaft 48
170—upper end of the forward rudder shaft 46
172—upper end of the other forward rudder shaft 48
174—lower end of the forward rudder shaft 46
176—lower end of the other forward rudder shaft 48
178—a forward cap
180—other forward cap
182—substantially cylindrical body of the aft rudder shaft 50
184—substantially cylindrical body of the other aft rudder shaft 52
186—upper end of the body 182
188—upper end of the body 184
190—lower end of the body 182
192—lower end of the body 184
194—an aft cap
196—other aft cap
198 to 212—a plurality of bolts
214 to 228—a plurality of nuts
230—center of lateral resistance on the forward hull 22
232—center of lateral resistance on the other forward hull 24
234—center of lateral resistance on the aft hull 26
236 —center of lateral resistance on the other aft hull 28
238—pivotal point of the forward hull 22
240—pivotal point of the other forward hull 24
242—pivotal point of the aft hull 26
244—pivotal point of the other aft hull 28
245—drawn water line
246—waves
248—lifting forces on the aft skag 34 and on the other aft skag 36
250—wave
252—arrow showing direction of movement of the wave 250
254—back-surge
256—arrow showing direction of movement of the back surge 254
258—windward side of the stable racing catamaran with hydrofoil qualities 10
260—leeward side of the stable racing catamaran with hydrofoil qualities 10
262—forces
264—bottom section stabilizers of the forward skag 30 and the other forward skag 32
266—bottom section stabilizers of the aft skag 34 and the other aft skag 36
268—planing surfaces of the forward skag 30 and the other forward skag 32
270—planing surfaces of the aft skag 34 and the other aft skag 36
272—rooster tail

DETAILED DESCRIPTION OF THE PREFERRED EMBODIMENT

Figures 4, 5, 5A:
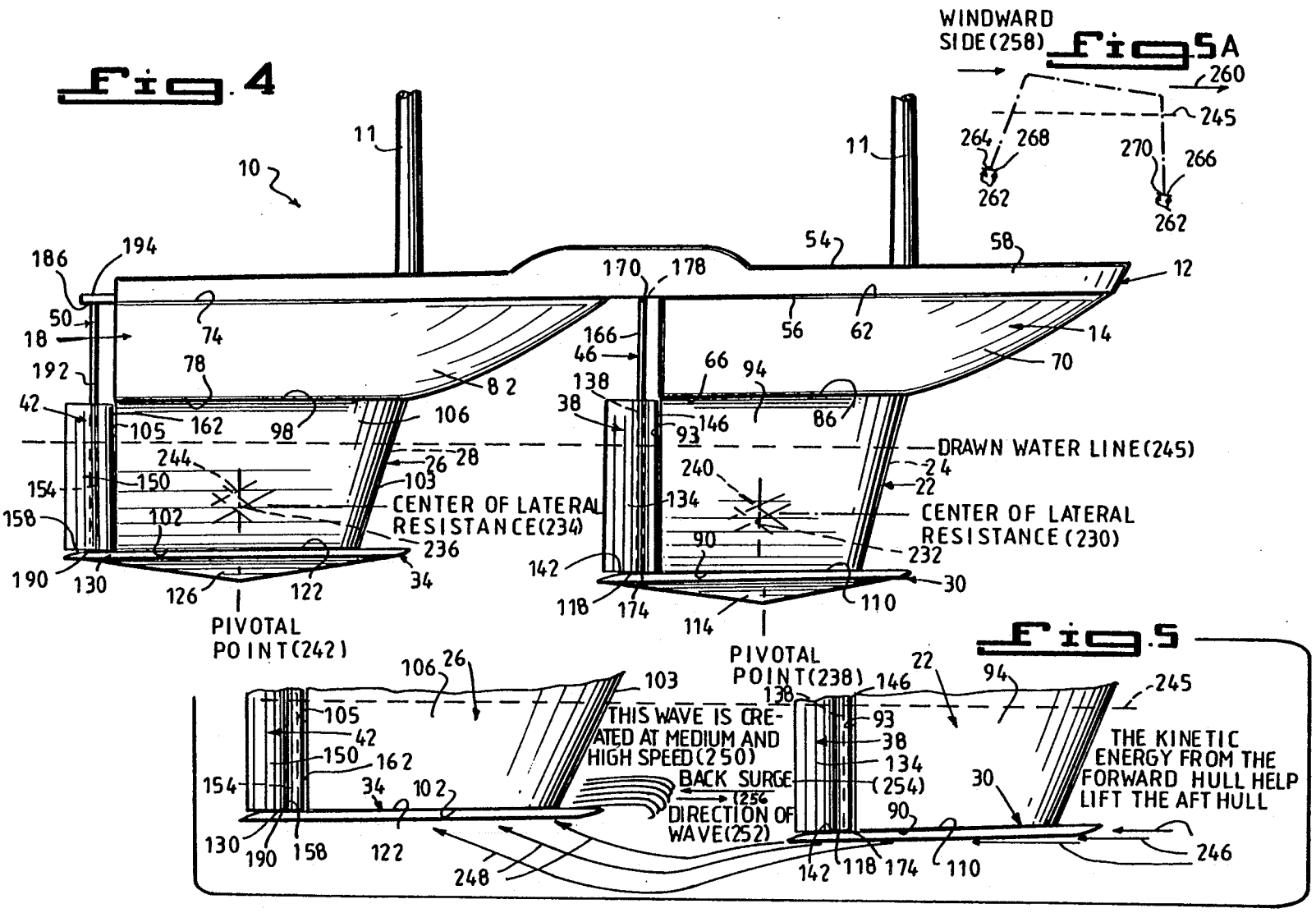
FIG. 4 is a side view of the stable racing catamaran with hydrofoil qualities of the present invention, shown in FIG. 1.
FIG. 5 is a side view of part of the stable racing catamaran with hydrofoil qualities of the present invention, shown in FIG. 4 and with its flow patterns shown.
FIG. 5A is a force diagram of the stable racing catamaran with hydrofoil qualities of the present invention, shown under sail in the windward direction.

Referring now to FIGS. 1, 2, and 4, the stable racing catamaran with hydrofoil qualities of the present invention is shown generally at 10 and includes a substantially flat deck 12, a pair of forward pylon 14 and 16, a pair of aft pylons 18 and 20, a pair of forward hulls 22 and 24, a pair of aft hulls 26 and 28, a pair of forward skags 30 and 32, a pair of aft skags 34 and 36, a pair of forward rudders, 38 and 40, a pair of aft rudders 42 and 44, a pair of forward rudder shafts 46 and 48, and a pair of aft rudder shafts 50 and 52. At least one mast 11 is used if the stable racing catamaran with hydrofoil qualities 10 of the present invention is powered by sails (not shown).

The substantially flat deck 12 includes an upper surface 54, a lower surface 56, and a pair of contoured sides 58 and 60.

The pair of forward pylons 14 and 16, include upper surfaces 62 and 64, respectively, lower surfaces 66 and 68, respectively, and bodies 70 and 72, respectively. The bodies 70 and 72 are shaped and positioned so as to match the contour of the pair of contoured sides 58 and 60, respectively, of the deck 12 so that air resistance is reduced and drag is minimized by streamlining.

The pair of forward pylons 14 and 16, are attached to the deck 12, where the upper surfaces 62 and 64, respectively, of the pair of forward pylons 14 and 16, respectively, meet the lower surface 56 of the substantially flat deck 12.

The pair of aft pylons 18 and 20, include upper surfaces 74 and 76, respectively, lower surfaces 78 and 80, respectively, and bodies 82 and 84, respectively. The bodies 82 and 84 are shaped and positioned so as to match the contour of the pair of contoured sides 58 and 60, respectively, of the deck 12 so that air resistance is further reduced and drag is further minimized.

The pair of aft pylons 18 and 20 are attached to the deck 12, where the upper surfaces 74 and 76, respectively, of the pair of aft pylons 18 and 20, respectively, meet the lower surface 56 of the substantially flat deck 12.

The pair of forward hulls 22 and 24, include upper surfaces 86 and 88, respectively, lower surfaces 90 and 92, respectively, bodies 94 and 96, respectively, and rear edges 93 and 95, respectively.

The pair of forward hulls 22 and 24 are attached to the pair of forward pylons 14 and 16, respectively, where the upper surfaces 86 and 88, respectively, of the pair of forward hulls 22 and 24, respectively, meet the lower surfaces 66 and 68, respectively, of the pair of forward pylons 14 and 16, respectively.

The pair of aft hulls 26 and 28 include upper surfaces 98 and 100, respectively, lower surfaces 102 and 104, respectively, bodies 106 and 108, respectively, and rear edges 105 and 107, respectively.

The pair of aft hulls 26 and 28 are attached to the pair of aft pylons 18 and 20, respectively, where the upper surfaces 98 and 100, respectively, of the pair of aft hulls 26 and 28, respectively, meet the lower surfaces 78 and 80, respectively, of the pair of aft pylons 18 and 20, respectively.

The pair of forward skags 30 and 32 include upper surfaces 110 and 112, respectively, lower fins 114 and 116, respectively, and rear portions 118 and 120, respectively.

The pair of forward skags 30 and 32, are attached to the pair of forward hulls 22 and 24, respectively, where the upper surfaces 110 and 112, respectively, of the pair of forward skags 30 and 32, respectively, meet the lower surfaces 90 and 92 of the forward hulls 22 and 24, respectively.

The pair of aft skags 34 and 36 include upper surfaces 122 and 124, respectively, lower fins 126 and 128, respectively, and rear portions 130 and 132, respectively.

The pair of aft skags 34 and 36 are attached to the pair of aft hulls 26 and 28, respectively, where the upper surfaces 122 and 124, respectively, of the pair of aft skags 34 and 36, respectively, meet the lower surfaces 102 and 104, respectively, of the aft hulls 26 and 28, respectively.

The pair of forward rudders 38 and 40 include bodies 134 and 136, respectively, that contain longitudinal throughbores 138 and 140, respectively, lower surfaces 142 and 144, respectively, and front portions 146 and 148, respectively.

The pair of aft rudders 42 and 44 include bodies 150 and 152, respectively, that contain longitudinal throughbores 154 and 156, respectively, lower surfaces 158 and 160, respectively, and front portions 162 and 164, respectively.

The pair of forward rudder shafts 46 and 48 include substantially cylindrical bodies 166 and 168, respectively, upper ends 170 and 172, respectively, and lower ends 174 and 176, respectively.

The pair of forward rudders 38 and 40 are rotatably mounted, by use of the pair of forward rudder shafts 46 and 48, respectively. The pair of forward rudder shafts 46 and 48 pass through the longitudinal throughbores 138 and 140, respectively, contained in the pair of forward rudders 38 and 40, respectively. The front portions 146 and 148 of the pair of forward rudders 38 and 40, respectively, are positioned adjacent to the rear edges 93 and 95 of the forward hulls 22 and 24, respectively.

The pair of forward rudders 38 and 40 are held adjacent to the rear edges 93 and 95, respectively, of the forward hulls 22 and 24, respectively, by the upper ends 170 and 172 of the pair of forward rudder shafts 46 and 48, respectively, being attached to forward caps 178 and 180, respectively, and the lower ends 174 and 176 of the pair of forward rudder shafts 46 and 48, respectively, being attached to the rear portions 118 and 120 of the forward skags 30 and 32, respectively.

The pair of aft rudder shafts 50 and 52 include substantially cylindrical bodies 182 and 184, respectively, upper ends 186 and 188, respectively, and lower ends 190 and 192, respectively.

The pair of aft rudders 42 and 44 ar rotatably mounted, by use of the pair of aft rudder shafts 50 and 52, respectively. The pair of aft rudder shafts 50 and 52 pass through the longitudinal throughbores 154 and 56, respectively, contained in the pair of aft rudders 42 and 44, respectively. The front portions 162 and 164 of the pair of aft rudders 42 and 44, respectively, are positioned adjacent to the rear edges 105 and 107 respectively, of the aft hulls 26 and 28, respectively.

The pair of aft rudders 42 and 44, are held adjacent to the rear edges 105 and 107, respectively, of the aft hulls 26 and 28, respectively, by the upper ends 170 and 172 of the pair of aft rudder shafts 50 and 52, respectively, being attached to the aft caps 194 and 196, respectively, and the lower ends 190 and 192 of the pair of aft rudder shafts 50 and 52, respectively, being attached to the rear portions 130 and 132 of the aft skags 34 and 36, respectively.

The forward hulls 22 and 24 and the aft hulls 26 and 28 are removably mounted to the forward pylons 14 and 16, respectively, and the aft pylons 18 and 20, respectively, as can be seen in FIG. 3. Furthermore, throughbolts 198, 200, 202, 204, 206, 208, 210, and 212, and nuts 214, 216, 218, 220, 222, 224, 226, and 228, permit the bolting and unbolting of different design and displacement hulls onto and off of the same forward pylons 14 and 16, respectively, and the same aft pylons 18 and 20, respectively so that the hulls can be quickly and easily changed, as required by the user.

As can be seen in FIG. 4, the centers 230 and 232 of lateral resistance are disposed on the bodies 94 and 96 of the pair of forward hulls 22 and 24, respectively. Likewise, the centers 234 and 236 of lateral resistance are disposed on the bodies 106 and 108 of the pair of aft hulls 26 and 28, respectively.

The centers 230 and 232 of lateral resistance of the pair of forward hulls 22 and 24, respectively, and the centers 234 and 236 of lateral resistance of the pair of aft hulls 26 and 28, respectively, absorb the lateral forces impinged thereon and minimize the unwanted side-to-side lateral motion of the stable racing catamaran with hydrofoil qualities 10 of the present invention.

The pivotal points 238 and 240 of the pair of forward hulls 22 and 24, respectively, and the pivotal points 242 and 244 of the pair of aft hulls 26 and 28, respectively, work in conjunction with each other to minimize the unwanted yaw motion of the stable racing catamaran with hydrofoil qualities 10 of the present invention.

The drawn water line 245, is shown in FIGS. 4 and 5, when the stable racing catamaran with hydrofoil qualities 10 of the present invention is in the dynamic state.

The dynamic flow pattern of the pair of forward hulls 22 and 24, the pair of aft hulls 26 and 28, the forward skags 30 and 32, and the aft skags 34 and 36 can be seen in FIG. 5.

The kinetic energy of the waves 246 created when pair of forward hulls 22 and 24, cut through the water produce lifting forces 248 o the aft skags 34 and 36 of the pair of aft hulls 26 and 28, respectively. Additionally, as the pair of forward hulls 22 and 24 cut through the water, less resistance is encountered by the pair of aft hulls 26 and 28, respectively.

Less resistance is encountered by the pair of aft hulls 26 and 28 as the pair of forward hulls 22 and 24, respectively, cut through the water because as the stable racing catamaran with hydrofoil qualities 10 of the present invention proceeds at medium to high speed, a wave 250 is created at the front portions 103 and 109 of the pair of aft hulls 26 and 28, respectively, that moves in the direction of arrow 252. The back-surge 254 moves in the direction of the arrow 256 and is produced in response to the forces created by the wave 250.

The force diagram of the stable racing catamaran with hydrofoil qualities 10 of the present invention, while in the dynamic state, is shown in FIG. 5A.

As the stable racing catamaran with hydrofoil qualities 10 is under sail into the wind, the pair of forward hulls 22 and 24 on the windward side 258 of the stable racing catamaran with hydrofoil qualities 10 lift further above the drawn water line 245 than the pair of aft hulls 26 and 28 that are on the leeward side 260 of the stable racing catamaran with hydrofoil qualities 10. This occurs due to the forces 262 exerted on the bottom section stabilizers 264 and 266 and the planing surfaces 268 and 270 of the forward skags 30 and 32, respectively, and the aft skags 34 and 36, respectively.

The inherent design of the stable racing catamaran with hydrofoil qualities 10 of the present invention will negate a greater degree of lateral drift than would a conventional vessel (not shown).

Figure 6:
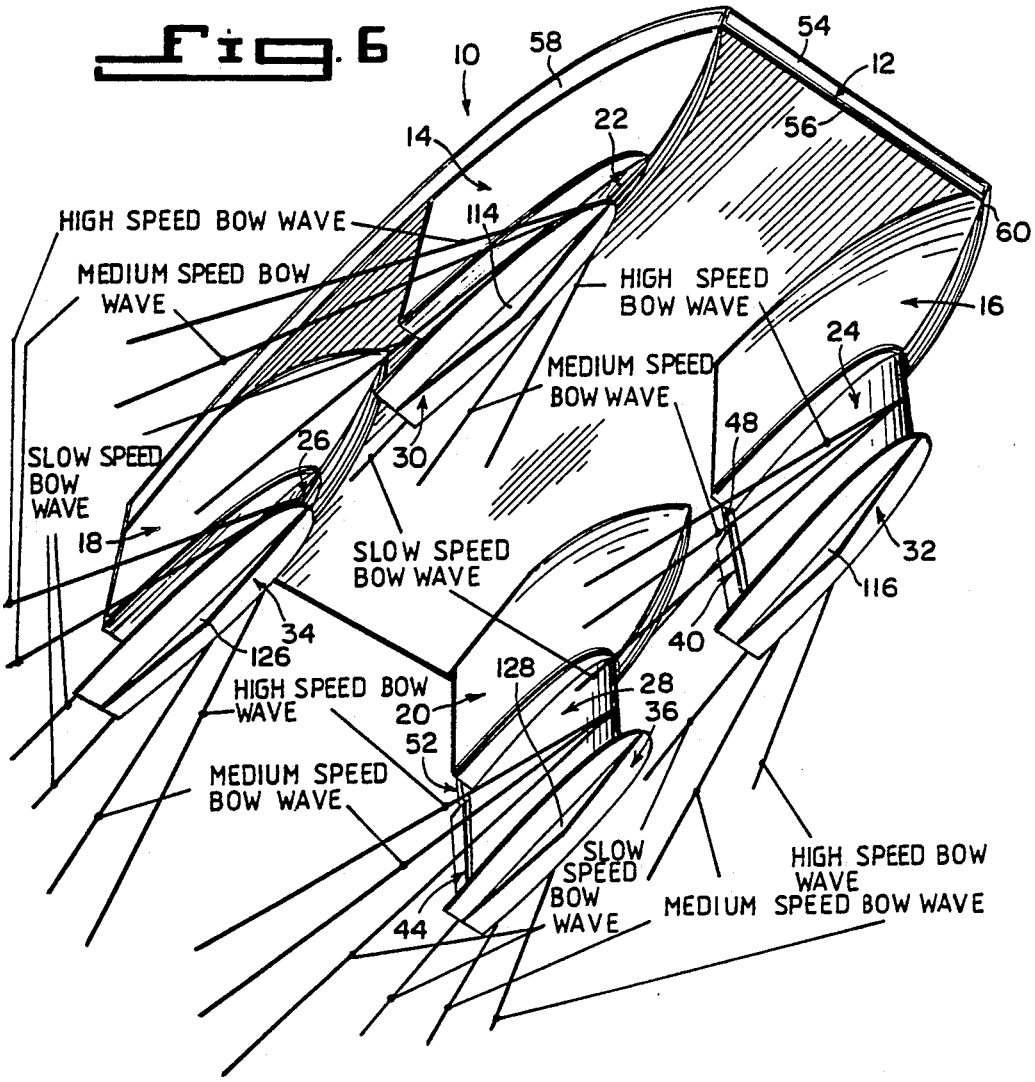
FIG. 6 is a bottom perspective view of the stable racing catamaran with hydrofoil qualities of the present invention, shown in FIG. 1 and with is wave creation patterns shown.

The size of the wave produced by the pair of forward hulls 22 and 24 and the pair of aft hulls 26 and 28 is dependent upon the speed at which the stable racing catamaran with hydrofoil qualities 10 dynamically proceeds through the water. The wave patterns that are dependent upon speed can be seen in FIG. 6.

A wake is formed behind a body which is moving through a fluid that is at rest. The velocities in a wake are smaller than those in the main stream and the losses in the velocity in the wake amount to a loss of momentum which is due to the drag on the moving body. The spread of the wake increases as the distance from the moving body is increased. The differences between the velocity in the wake and that outside the wake become smaller in addition to the differences in the surface tension of the fluid.

It can be seen that the greater the speed of the stable racing catamaran with hydrofoil qualities 10, the larger the waves, and ultimately the wider the wakes. The wider the wakes from the waves created by the pair of forward hulls 22 and 24 the less resistance is imposed upon the pair of aft hulls 26 and 28, respectively, as the pair of aft hulls 26 and 28 pass through the wakes created by the pair of forward hulls 22 and 24.

Figure 7:
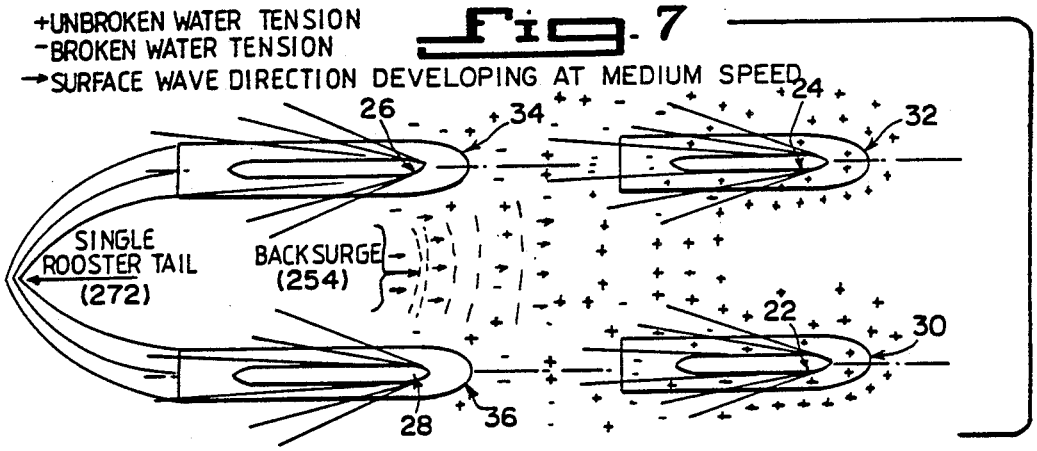
FIG. 7 is a plan view of the pair of forward hulls and the pair of aft hulls of the stable racing catamaran with hydrofoil qualities of the present invention and showing the water surface tension distribution.

The broken water surface tension is in close proximity to the pair of forward hulls 22 and 24 and to the pair of aft hulls 26 and 28 and further forms the boundary layers, respectively. However, the water surface tension remains unbroken and undisturbed as the proximity to the pair of forward hulls 22 and 24 and to the pair of aft hulls 26 and 28 decreases. This reduces the drag by minimizing the amount of compounding of the created waves upon each other, and also increases the lift due to the formation of the boundary layers, respectively, as can be seen in FIG. 7. The rooster tails created by the back-wash from the pair of aft hulls 26 and 28 combine and form a single rooster tail 272, while the boundary layer separation on the lifting surfaces remain nil.

It will be understood that each of the elements described above, or two or more together, may also find a useful application in other types of constructions differing from the type described above.

The present invention has been illustrated as a stable racing catamaran powered by sail. It is also the intent of this invention to be utilized as a powered vessel. Using state of the art mechanical propulsion, the present invention can be used as a powered vessel (minus the sail).

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A stable racing catamaran with hydrofoil qualities, comprising:

(a) a deck;

(b) a pair of forward pylons affixed to said deck;

(c) a pair of aft pylons affixed to said deck;

(d) a pair of forward hulls affixed to said pair of forward pylons, respectively;

(e) a pair of aft hulls affixed to said pair of aft pylons, respectively;

(f) a pair of forward skags affixed to said pair of forward hulls, respectively;

(g) a pair of aft skags affixed to said pair of aft hulls, respectively;

(h) a pair of forward rudders disposed in close proximity to said pair of forward hulls, respectively;

(i) a pair of aft rudders disposed in close proximity to said pair of aft hulls, respectively;

(j) a pair of forward rudder shafts for rotatably mounting said pair of forward rudders, respectively;

(k) a pair of aft rudder shafts for rotatably mounting said pair of aft rudders, respectively; said deck is substantially flat and includes a pair of sides having contours, an upper surface, a forward portion, and an aft portion; said pair forward pylons include a pair of upper surfaces, respectively, a pair of lower surfaces, respectively, and a pair of bodies, respectively, said bodies being shaped and positioned so as to match said contours, respectively, of said pair of sides, respectively, of said deck so that air resistance is reduced and drag is minimized by streamlining; said pair of forward pylon are affixed to said forward portion of said deck where said pair of upper surfaces, respectively, of said pair of forward pylons, respectively, meet said lower surface of said deck;

said pair of aft pylons include a pair of upper surfaces, respectively, and a pair of lower surfaces, respectively, and a pair of bodies, respectively, said pair of bodies being shaped and positioned so as to match said contour, respectively, of said pair of sides respectively, of said deck so that air resistance is further reduced and drag is further minimized by streamlining;

said pair of aft pylons are affixed to said aft portion, respectively, of said deck where said pair of upper surfaces, respectively, of said pair of aft pylons, respectively, meet said lower surface of said deck;

said pair of forward hulls includes a pair of upper surfaces, respectively, a pair of lower surfaces, respectively, a pair of bodies, respectively, and a pair of rear edges, respectively;

said pair of forward hulls are affixed to said pair of forward pylons, respectively, where said pair of upper surfaces of said pair of forward hulls, respectively, meet said pair of lower surfaces of said pair of forward pylons, respectively;

said pair of aft hulls include a pair of upper surfaces, respectively, a pair of lower surfaces, respectively, a pair of bodies, respectively, and a pair of rear edges, respectively;

said pair of aft hulls are affixed to said pair of aft pylons, respectively, where said pair of upper surfaces of said pair of aft hulls, respectively, meet said pair of lower surfaces of said pair of aft pylons, respectively; and said pair of forward skags include a pair of upper surfaces, respectively, a pair of lower fins, respectively, and a pair of rear portions, respectively.

2. A catamaran as defined in claim 1, wherein said pair of forward skags are affixed to said pair of forward hulls, respectively, where said pair of upper surfaces of said pair of forward skags, respectively, meet said pair of lower surfaces of said pair of forward hulls, respectively.

3. A catamaran as defined in claim 2, wherein said pair of aft skags include a pair of upper surfaces, respectively, a pair of lower fins, respectively, and a pair of rear portions, respectively.

4. A catamaran as defined in claim 3, wherein said pair of aft skags are affixed to said pair of aft hulls, respectively, where said pair of upper surfaces of said pair of aft skags, respectively, meet said pair of lower surfaces of said pair of aft hulls, respectively.

5. A catamaran as defined in claim 4, wherein said pair of forward rudders include a pair of bodies, respectively, each of which containing a longitudinal throughbore said pair of forward rudders further including a pair of lower surfaces, respectively, and a pair of front portions, respectively.

6. A catamaran as defined in claim 5, wherein said pair of aft rudders include a pair of bodies, respectively, each of which containing a longitudinal throughbore, said pair of aft rudders further including a pair of lower surfaces, respectively, and a pair of front portions, respectively.

7. A catamaran as defined in claim 6, wherein said pair of forward rudder shafts include a pair of substantially cylindrical bodies, respectively, a pair of upper ends, respectively, and a pair of lower ends, respectively.

8. A catamaran as defined in claim 7; further comprising a pair of forward rudder shaft caps.

9. A catamaran as defined in claim 8, wherein said pair of forward rudders are rotatably mounted by use of said pair of forward rudder shafts, respectively, said pair of forward rudder shafts passing through said longitudinal throughbores contained in said pair of forward rudders, respectively, said pair of front portions of said pair of forward rudders, respectively, being positioned adjacent to said pair of rear edges of said pair of forward hulls, respectively.

10. A catamaran as defined in claim 9, wherein said pair of forward rudders are held adjacent to said pair of rear edges, of said pair of forward hulls, respectively, by said pair of upper ends of said pair of forward rudder shafts, respectively, being affixed to said pair of forward rudder shaft caps, respectively, and said pair of lower ends of said pair of forward rudder shafts, respectively, being affixed to said pair of rear portions of said pair of forward skags, respectively.

11. A catamaran as defined in claim 10, wherein said pair of aft rudder shafts include a pair of substantially cylindrical bodies, respectively, a pair of upper ends, respectively, and a pair of lower ends, respectively.

12. A catamaran as defined in claim 11; further comprising a pair of aft rudder shaft caps.

13. A catamaran as defined in claim 12, wherein said pair of aft rudders are rotatably mounted by use of said pair of aft rudder shafts, respectively, said pair of aft rudder shafts passing through said longitudinal throughbores contained in said pair of aft rudders, respectively, said pair of front portions of said pair of aft rudders, respectively, being positioned adjacent to said pair of rear edges of said pair of aft hulls, respectively.

14. A catamaran as defined in claim 13, wherein said pair of aft rudders are held adjacent to said pair of rear edges of said pair of aft hulls, respectively, by said pair of upper ends of said pair of aft rudder shafts, respectively, being affixed to said pair of aft rudder shaft caps, respectively, and said pair of lower ends of said pair of aft rudder shafts, respectively, being affixed to said pair of rear portions of said pair of aft skags, respectively.

15. A catamaran as defined in claim 14, wherein said pair of forward hulls are removably mounted to said pair of forward pylons, respectively, so that said pair of forward hulls can have different designs and displacements which can be quickly and readily attached to or removed from said pair of forward pylons, respectively, as required by the user.

16. A catamaran as defined in claim 15; further comprising a plurality of nuts and bolts for removably affixing said pair of forward hulls to said pair of forward pylons, respectively.

17. A catamaran as defined in claim 16, wherein said pair of aft hulls are removably mounted to said pair of aft pylons, respectively, so that said pair of aft hulls can have different designs and displacements which can be quickly and readily attached to or removed from said pair of aft pylons, respectively, as required by the user.

18. A catamaran as defined in claim 17; further comprising a plurality of nuts and bolts for removably affixing said pair of aft hulls to said pair of aft pylons, respectively.

19. A catamaran as defined in claim 18, wherein said pair of bodies of said pair of forward hulls, respectively, and said pair of bodies of said pair of aft hulls, respectively, have centers of lateral resistance, respectively, disposed thereon, said centers of lateral resistance absorb lateral forces impinged thereon and minimize unwanted side-to-side lateral motion and drift that affects stability.

20. A catamaran as defined in claim 19, wherein said pair of forward hulls and said pair of aft hulls have pivotal points, respectively, disposed therethrough, said pivotal points of said forward hulls, respectively, and said pivotal points of said aft hulls, respectively, working in conjunction with each other to minimize unwanted yaw motion that affects stability.

21. A catamaran as defined in claim 20, wherein said pair of forward hulls create waves that contain kinetic energy, said kinetic energy producing lifting forces on said pair of aft skags of said pair of aft hulls, respectively, which reduces resistance encountered by said pair of aft hulls.

* * * * *